US009815088B1

(12) United States Patent
Knorr

(10) Patent No.: US 9,815,088 B1
(45) Date of Patent: Nov. 14, 2017

(54) SCREENING APPARATUS

(71) Applicant: Brian Knorr, Henrico, VA (US)

(72) Inventor: Brian Knorr, Henrico, VA (US)

(73) Assignee: Metso Minerals, Inc., Helsinki (FI)

( * ) Notice: Subject to any disclaimer, the term of this patent is extended or adjusted under 35 U.S.C. 154(b) by 0 days.

(21) Appl. No.: 15/145,973

(22) Filed: May 4, 2016

(51) Int. Cl.
*B07B 11/06* (2006.01)
*B07B 1/28* (2006.01)

(52) U.S. Cl.
CPC ..... *B07B 11/06* (2013.01); *B07B 1/284* (2013.01); *B07B 2201/04* (2013.01); *B07B 2230/01* (2013.01)

(58) Field of Classification Search
CPC ..... B07B 1/46; B07B 2201/04; B07B 11/06
USPC ..... 209/313–317, 319
See application file for complete search history.

(56) References Cited

U.S. PATENT DOCUMENTS 2,683,533 A * 7/1954 Paul ..... B07B 1/30 209/315
4,085,776 A 4/1978 Derrick, Jr.
4,234,416 A * 11/1980 Lower ..... B07B 13/16 209/247
4,322,288 A * 3/1982 Schmidt ..... B02B 1/02 209/240
4,576,713 A * 3/1986 Melin ..... B07B 1/46 137/561 A
4,634,535 A * 1/1987 Lott ..... B01D 21/00 209/311
4,818,379 A * 4/1989 Eggerstedt ..... B07B 1/46 209/247
6,889,846 B2 * 5/2005 Olsen ..... B07B 1/46 209/309
8,453,844 B2 * 6/2013 Bailey ..... B01D 33/0338 175/206
8,956,543 B2 2/2015 Carr et al.
9,205,459 B2 * 12/2015 Sauser ..... B07B 1/28
9,387,517 B2 * 7/2016 Carr ..... B07B 1/46
2014/0263103 A1 9/2014 Peresan et al.

* cited by examiner

*Primary Examiner* — Joseph C Rodriguez
(74) *Attorney, Agent, or Firm* — Andrus Intellectual Property Law, LLP

(57) ABSTRACT

A screening apparatus is disclosed. The screening apparatus includes a support; at least two screen decks arranged one over the other as an assembly, each screen deck including a screen frame, a screen and a chamber underlaying the screen surface, an outlet duct for oversized material and an outlet duct for undersized material that is in communication with the chamber; mountings configured for mounting of the assembly of the at least two screen decks to the support; and a feed unit configured to feed the material to be screened to each screen deck. The feed unit includes at least one distributor having one distributor inlet and at least two distributor outlets, which at least two distributor outlets are arranged to feed one screen deck each.

13 Claims, 8 Drawing Sheets

SCREENING APPARATUS

FIELD OF THE INVENTION

The present invention relates to a screening apparatus comprising a plurality of piled screening decks.

BACKGROUND

Screening apparatuses for wet fine particle sizing and separation are widely used in mineral processing facilities, but also in drilling industry for removing drill cuts from drilling fluids. Also vibratory screening apparatuses are used in mineral processing.

In certain situations floor space is at a premium and therefore it is advantageous to have screening decks piled on top of each other. Thus, a small foot print is of importance, as well as a compact arrangement of screening decks and easy maintenance thereof. At the same time it is important to provide and maintain an even distribution of the wet fine particles onto the screens.

SUMMARY

An object of the invention is to provide a screening apparatus which allows compact arrangement of screen decks with even distribution of particles onto the screens.

Another object of the invention is to provide a screening apparatus with improved distribution of particles onto the screens.

According to a first aspect of the invention, these and other objects are achieved, in full or at least in part, by a screening apparatus comprising a support; at least two screen decks arranged one over the other as an assembly, each screen deck including a screen and a chamber underlaying the screen surface, an outlet duct for oversized material and an outlet duct for undersized material that is in communication with the chamber; mountings configured for mounting of the assembly of the at least two screen decks to the support; and a feed unit configured to feed the material to be screened to each screen deck; wherein the feed unit comprises at least one distributor having one distributor inlet and at least two distributor outlets, which at least two distributor outlets are arranged to feed one screen deck each.

With this inventive feed unit, a compact arrangement of screen decks is possible without compromising on the distribution of the particles onto the screens.

In one embodiment of the invention, the at least one distributor has a conduit arrangement comprising a splitter opening arrangement, which comprises openings arranged in an extension perpendicular to a feed flow direction, and which openings have conduits that are divided to either be in communication with a first distributor outlet of the at least two distributor outlets or to be in communication with a second distributor outlet of the at least two distributor outlets.

With this splitter opening arrangement, a distribution of the feed may easily be divided between the first and the second distributor outlet.

In one embodiment the openings are arranged in an extension perpendicular to a feed flow direction and in the full width of the distributer.

In one embodiment the distributor outlets have a pan-like form having a width of the screen deck in order to spread the particles onto the screen deck.

In one embodiment the splitter opening arrangement comprises vanes arranged in parallel with each other forming openings in between the vanes.

In one embodiment, the conduit arrangement, upstream of the splitter opening arrangement, further comprises a first redirecting wall; a bottom wall; and a second redirecting wall, which each are configured to redirect the feed flow within the distributor.

With such a conduit arrangement, the feed is redirected a number of times, which compels the feed to spread to the full width of the conduit arrangement before being split between the openings having conduits in communication with a first distributor outlet or conduits in communication with a second distributor outlet.

In one embodiment, the splitter opening arrangement comprises vanes in parallel to each other and arranged perpendicular to the second redirecting wall, wherein the vanes form vane openings in between, which are configured to split the feed of material before reaching an end of the second redirecting wall.

In one embodiment the vane openings are arranged in communication with and positioned to correspond with the openings having conduits that are divided to either be in communication with the first distributor outlet or the second distributor outlet.

In another embodiment the vanes openings are arranged in communication with the conduit openings, but the vanes openings are not positioned to correspond with the conduit openings. Instead the vanes openings may be offset from the conduit openings.

In a further embodiment, the splitter opening arrangement is detachably arranged in relation to the rest of the conduit arrangement. In one embodiment the splitter opening arrangement comprises at least two detachably arranged parts in relation to the rest of the conduit arrangement.

In one embodiment the part of the splitter opening arrangement comprising vanes is arranged as a separate part to the splitter opening arrangement comprising conduit openings, which conduit openings are divided to either be in communication with the first distributor outlet or the second distributor outlet of the at least two distributor outlets.

In one embodiment of the invention, the splitter opening arrangement comprises openings of different sizes for differentiated feed to each of the at least two distributor outlets.

In another embodiment, the splitter opening arrangement comprises a tailored distribution between openings having conduits in communication with a first distributor outlet and openings having conduits in communication with a second distributor outlet of the at least two distributor outlets.

In a further embodiment, the splitter opening arrangement comprises deflection plates arranged downstream of the splitter opening arrangement. With deflection plates adjustment of the feed flow speed is enabled.

In one embodiment of the invention, at least one of the conduits between the splitter opening arrangement and the at least two distributor outlets comprises an overflow restrictor plate. Such an overflow restrictor plate, again compels the feed to spread to the full width of the distributor outlet, before entering out onto the screen deck.

In one embodiment the screening apparatus is a vibratory screening apparatus further comprising a drive support with a motor assembly configured for vibrating the assembly of the at least two screen decks.

When the screening apparatus is a vibratory screening apparatus, the above disclosed mountings may be resilient mountings.

In one embodiment of the vibratory screening apparatus, the assembly of the at least two screen decks has a first side facing the support, wherein the assembly is fastened to the support with at least two resilient mountings.

In a further embodiment of the vibratory screening apparatus, the assembly has a second side, opposite the first side, wherein the second side of the assembly is fastened to the drive support, and wherein the drive support is fastened to the support with at least two resilient mountings.

According to a second aspect of the invention, the above given and other objects are achieved in full or at least in part, by a screening apparatus comprising screen decks, and a feed unit configured to feed the material to be screened to different screen decks; wherein the feed unit comprises at least one distributor having one distributor inlet and at least two distributor outlets, which at least two distributor outlets are arranged to feed one screen deck each; and wherein the at least one distributor has a conduit arrangement comprising a splitter opening arrangement, which comprises openings arranged in an extension perpendicular to a feed flow direction, and which openings have conduits that are divided to either be in communication with a first distributor outlet or to be in communication with a second distributor outlet of the at least two distributor outlets.

Other objectives, features and advantages of the present invention will appear from the following detailed disclosure, from the attached claims, as well as from the drawings. It is noted that the invention relates to all possible combinations of features.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise. The steps of any method disclosed herein do not have to be performed in the exact order disclosed, unless explicitly stated.

As used herein, the term "comprising" and variations of that term are not intended to exclude other additives, components, integers or steps.

BRIEF DESCRIPTION OF THE DRAWINGS

The invention will be described in more detail with reference to the appended schematic drawings, which show examples of presently preferred embodiments of the invention.

DETAILED DESCRIPTION

Figure 1:
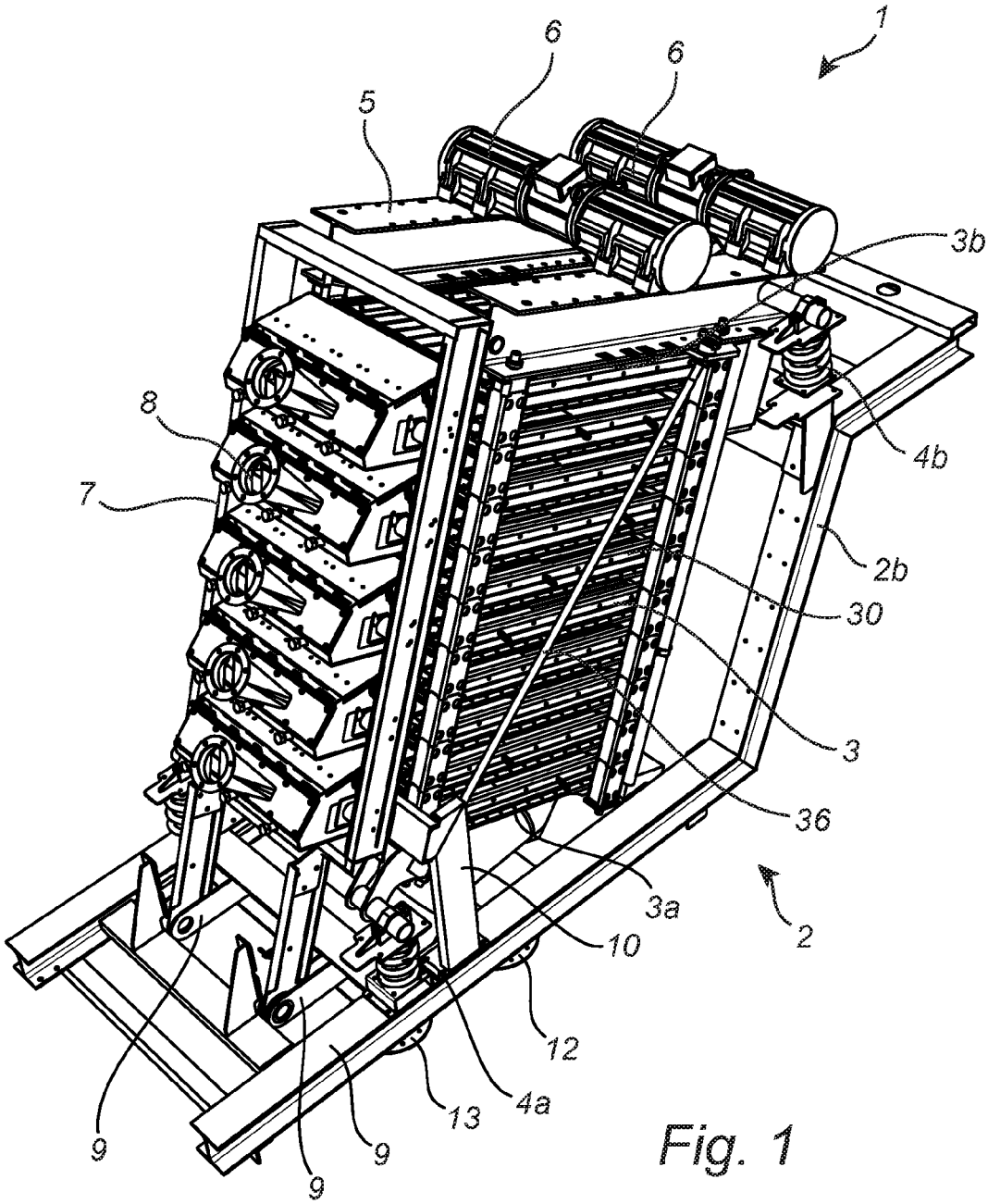
FIG. 1 is a perspective view of a screening apparatus according to one embodiment of the invention.

The present invention will now be described more fully hereinafter with reference to the accompanying drawings, in which currently preferred embodiments of the invention are shown. The present invention may, however, be embodied in many different forms and should not be construed as limited to the embodiments set forth herein; rather, these embodiments are provided for thoroughness and completeness, and to fully convey the scope of the invention to the skilled addressee. Like reference characters refer to like elements throughout.

Figure 2:
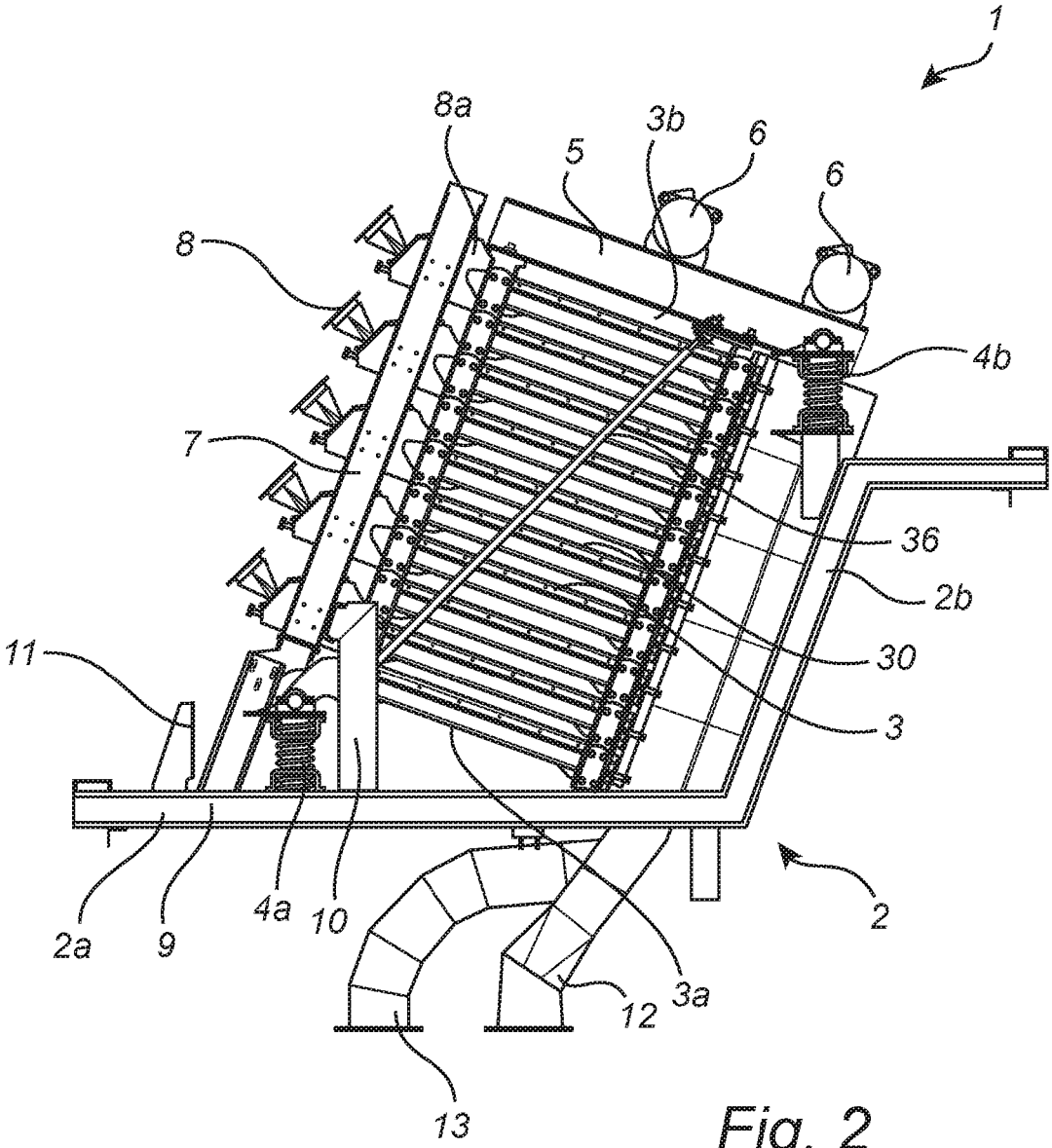
FIG. 2 is a side view of the screening apparatus.
Figure 3:
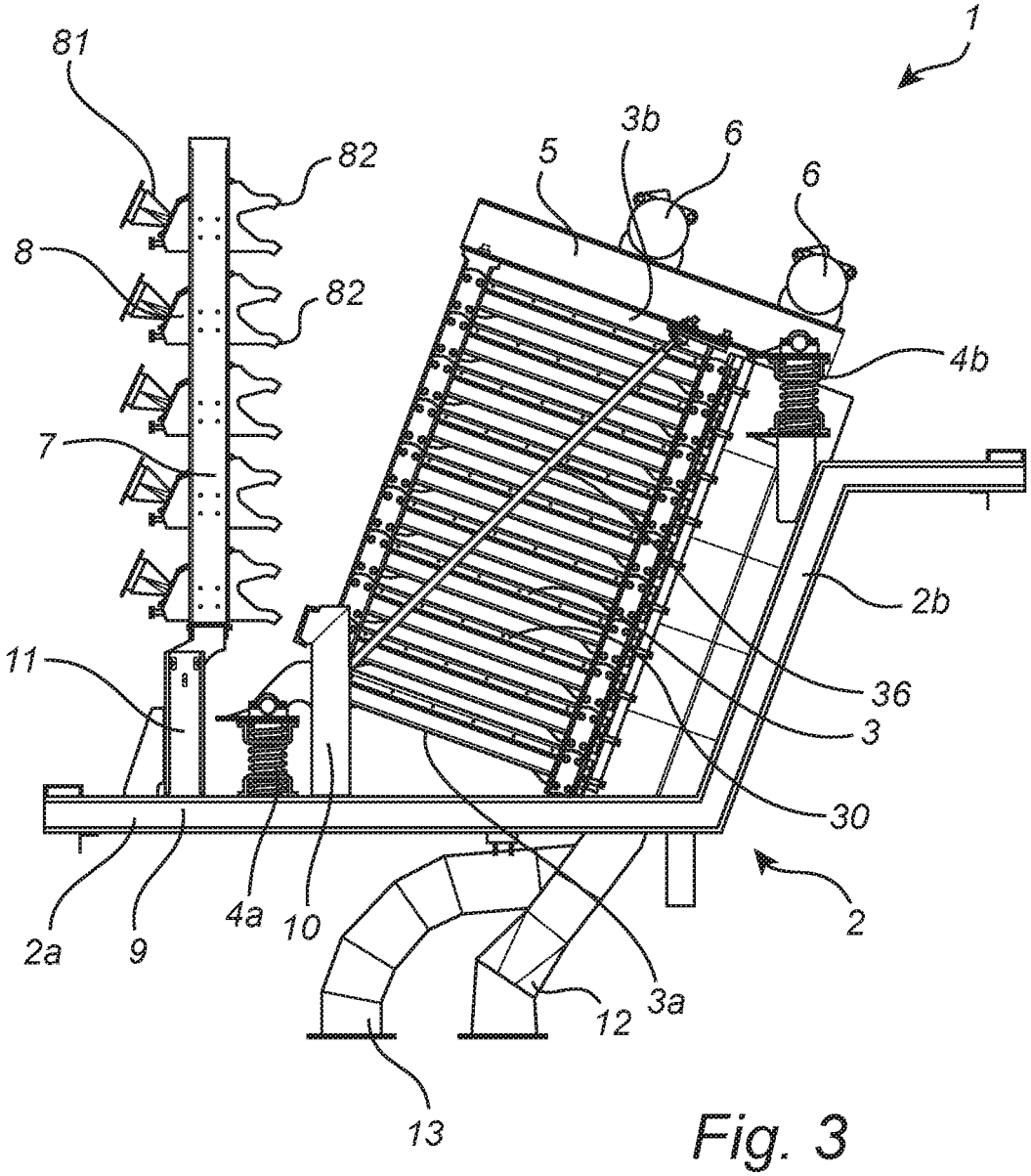
FIG. 3 is a side view of the screening apparatus with the feed unit removed from the assembly of screen decks.

FIGS. 1, 2 and 3 show a screening apparatus 1 according to one embodiment of the invention. This screening apparatus 1 is a vibratory screening apparatus. The screening apparatus 1 has a support 2 including a lower part 2*a* and an inclined part 2*b*. Screen decks 30 are piled directly on top of each other forming an assembly 3 of the screen decks 30. The assembly 3 of screen decks 30 has a first side 3*a* facing the lower part 2*a* of the support 2, which first side 3*a* is attached with the lower part 2*a* of the support 2 with two resilient mountings 4*a*. On a second side 3*b*, opposite the first side 3*a*, the assembly 3 of screen decks 30 is attached to a drive support 5 with a motor assembly 6. The drive support 5 is attached to the inclined part 2*b* of the support 2 with two resilient mountings 4*b*.

A feed unit 7 with a number of distributors 8 is arranged on the support 2 with an articulated coupling 9 to be moved between a feed position as shown in FIGS. 1 and 2, and a maintenance position as shown in FIG. 3.

The screening apparatus 1 further has an abutment support 10 attached to the lower part 2*a* of the support 2, and this abutment support 10 is arranged to provide an abutment surface for the feed unit 7 when set in the feed position. Thus, the feed unit 7 does not rest upon the assembly 3 of screen decks 30, but only align the different distributors 8 with the screen decks 30. With this arrangement the feed unit 7 will, during operation, be still while the assembly 3 of the at least two screen decks 30 will vibrate.

The feed unit 7 is configured to feed the material to be screened to each screen deck 30, and according to the shown embodiment the feed unit 7 comprises distributors 8, which each have one distributor inlet 81 and two distributor outlets 82-1, 82-2, wherein the two distributor outlets 82-1, 82-2 are arranged to feed one screen deck 30 each.

Figure 4:
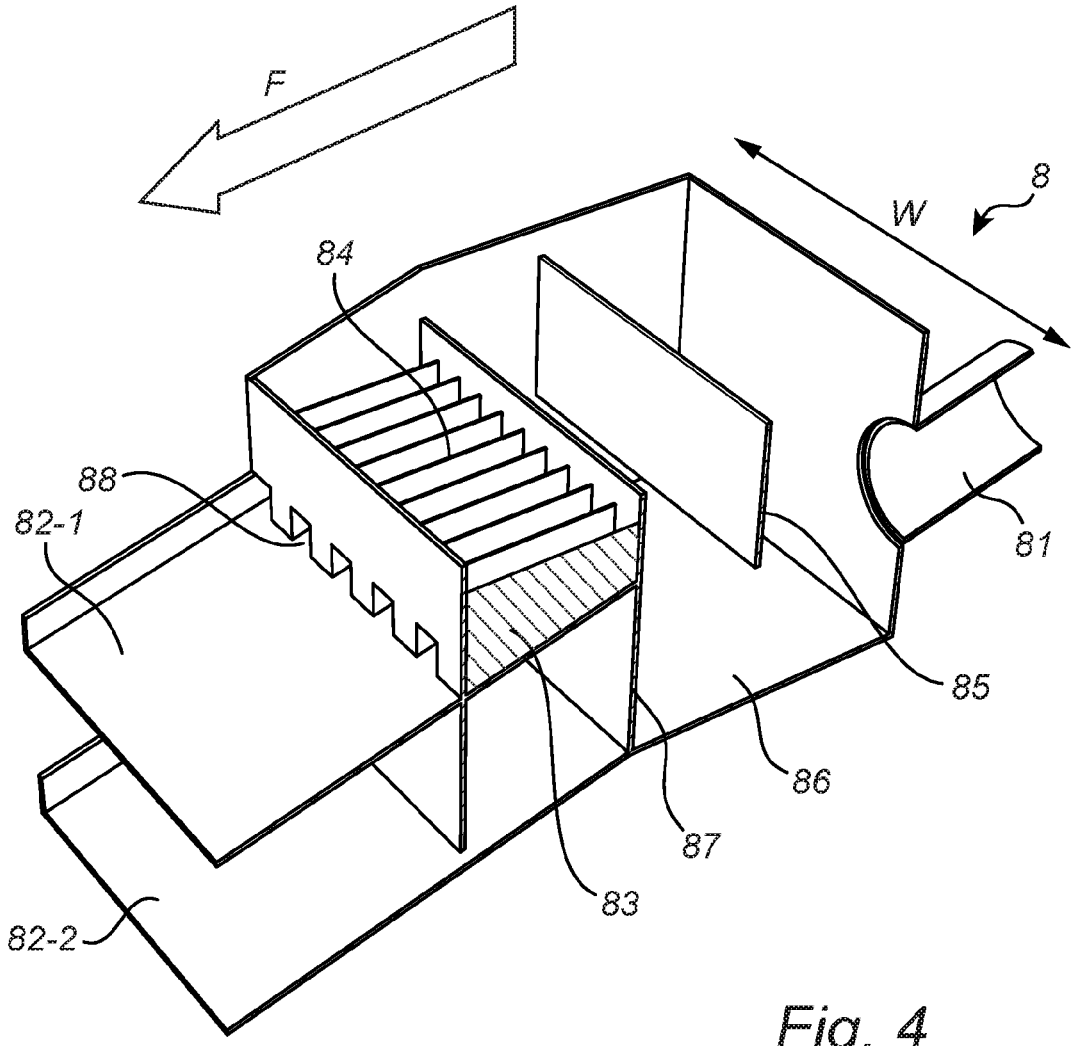
FIG. 4 is a partial cross-sectional view of a distributor according to one embodiment of the invention.

In FIG. 4 a partial cross-sectional view is shown of one embodiment of a distributor 8 according to the invention. The shown distributor 8 has one distributor inlet 81, and two distributor outlets 82-1, 82-2. The distributor 8 further has a conduit arrangement comprising a splitter opening arrangement 83, comprising openings 84. The splitter opening arrangement 83 is arranged in an extension perpendicular to a feed flow direction F, and is arranged to extend the full width W of the distributor 8. Each opening 84 has an extension in the feed flow direction F.

The conduit arrangement of the distributor 8 further comprises a couple of redirecting walls, a first redirecting wall 85, which redirects the incoming feed down towards the bottom wall 86 and under the first redirecting wall 85, and a second redirecting wall 87, which redirects the flow to be pressed up along the redirecting wall 87, and at the same time spread to the full width W of the distributor 8. After having reached the upper edge of the second redirecting wall 87, the feed flows over the edge and distribute between the openings 84. In the shown embodiment every second opening 84 have conduits 88 in communication with the first distributor outlet 82-1, and the remaining openings 84 have conduits 88 in communication with the second distributor outlet 82-2.

Figure 5:
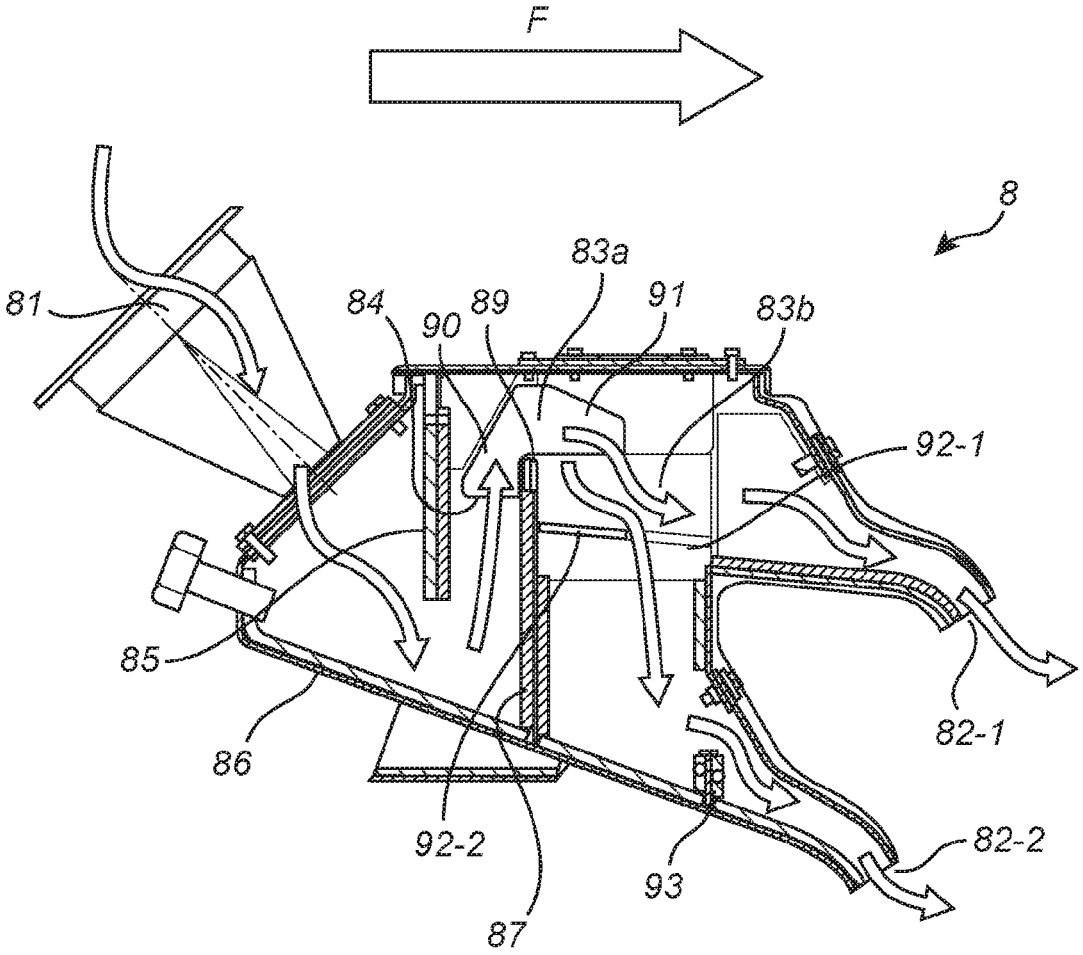
FIG. 5 is a cross-sectional view of a distributor according to another embodiment of the invention.

In FIG. 5 a cross-sectional view of another embodiment of a distributor according to the invention is shown. Also this distributor 8 has one distributor inlet 81, and two distributor outlets 82-1, 82-2. The distributor 8 also has a conduit arrangement comprising a splitter opening arrangement 83, comprising openings. The splitter opening arrangement 83 is arranged in an extension perpendicular to a feed flow direction F, and is arranged to extend the full width W of the distributor 8. The conduit arrangement of the distributor 8 further comprises a couple of redirecting walls, a first redirecting wall 85, which redirects the incoming feed down towards the bottom wall 86 and under the first redirecting wall 85, and a second redirecting wall 87, which redirects the flow to be pressed up along the redirecting wall 87, and at the same time spread to the full width W of the distributor 8. In this embodiment the splitter opening arrangement 83*a* has its openings arranged so that the feed enters into the openings 84 when approaching the upper part of the redirecting wall 87. In this splitter opening arrangement 83, the feed enters into a first part 83*a* of the splitter opening arrangement 83. In this first part 83*a* a first slot redirecting wall 89 is arranged as an extension of the second redirecting wall 87. Also arranged with this first part 83*a* is a second 90 and a third slot redirecting wall 91. After having reached the upper edge of the first slot redirecting wall 89, the feed flows over the edge and further in the openings 84 arranged in a second part 83*b* of the splitter opening arrangement 83. Again in this embodiment, every second opening 84 have conduits in communication with the first distributor outlet 82-1, and the remaining openings have conduits in communication with the second distributor outlet 82-2. In this embodiment the splitter opening arrangement parts 83*a* and 83*b* is detachably arranged in relation to the rest of the conduit arrangement. Thus, when worn out, these parts are easily replaced with new corresponding parts. Deflection plates 92 are arranged downstream of the splitter opening arrangement 83. For the openings in communication with the first distributor outlet 82-1, the deflection plates 92-1 cover the full opening extension in the feed flow direction F in order to lead the feed to the first distributor outlet 82-1. For the openings in communication with the second distributor outlet 82-2, the deflection plates 92-2 partially cover the opening extension in the feed flow direction F. The conduit between the splitter opening arrangement 83 and second distributor outlet 82-2 further comprises an overflow restrictor plate 93. This ensures that the feed is spread to the full width of the distributor before entering out through the distributor outlet 82-2 and onto the screen deck 30 to which it is aligned in feeding position.

Figure 8:
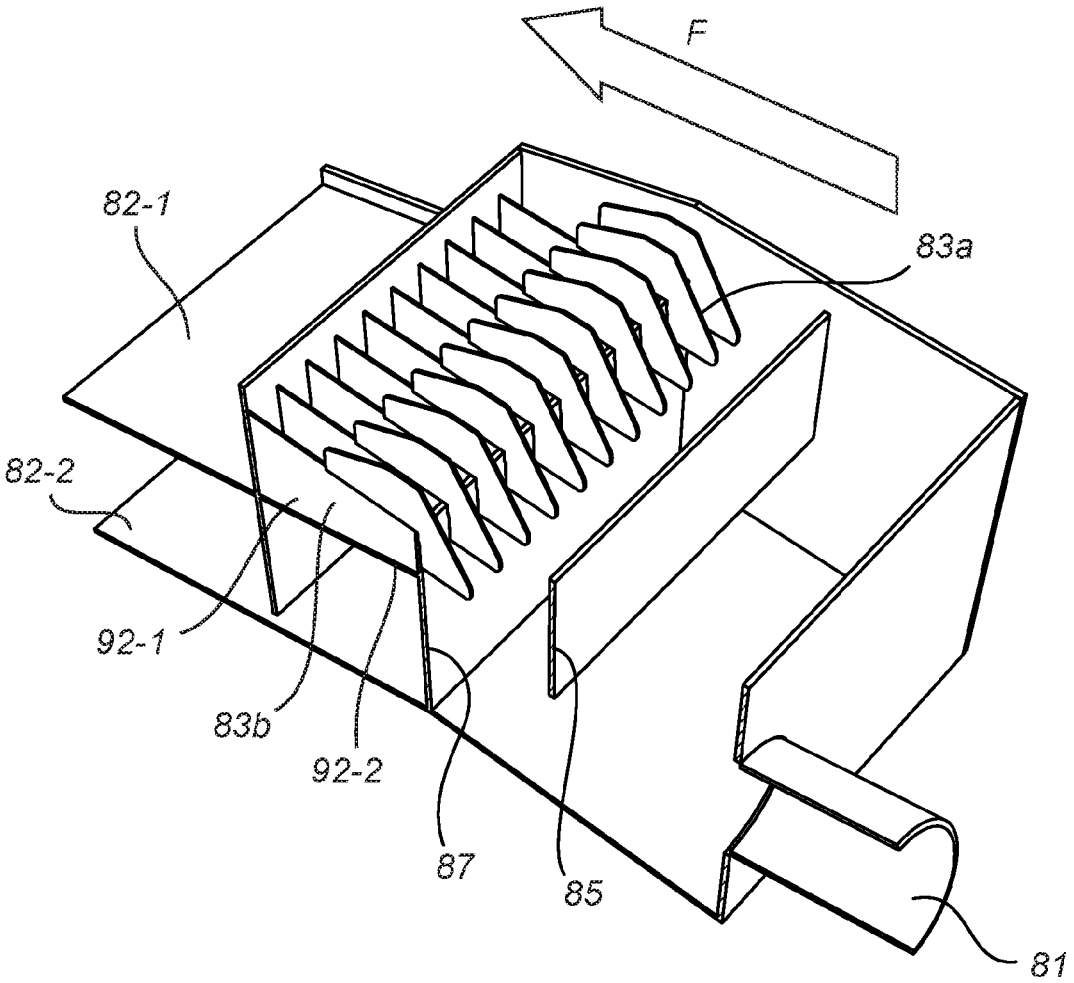
FIG. 8 is a perspective view of a partial cross-sectional view of a distributor according to a further embodiment of the invention.

In FIG. 8 a further embodiment of the distributor is shown. This embodiment also has one distributor inlet 81, and two distributor outlets 82-1, 82-2. The distributor 8 also has a conduit arrangement comprising a splitter opening arrangement 83, comprising openings. The splitter opening arrangement 83 is arranged in an extension perpendicular to a feed flow direction F, and is in the shown embodiment arranged to extend the full width W of the distributor 8.

The conduit arrangement of the distributor 8 further also comprises a couple of redirecting walls, a first redirecting wall 85, which redirects the incoming feed down towards the bottom wall 86 and under the first redirecting wall 85, and a second redirecting wall 87, which redirects the flow to be pressed up along the redirecting wall 87, and at the same time spread to the full width of the distributor 8.

In this embodiment the splitter opening arrangement 83 comprises vanes arranged perpendicular to the second redirecting wall 87, and the vanes forms openings arranged so that the feed enters into the openings 84*a* when approaching the upper part of the redirecting wall 87. Also in this splitter opening arrangement 83, the feed enters into a first part 83*a* of the splitter opening arrangement 83 before reaching an upper edge of second redirecting wall 87. After having reached the upper edge of the second redirecting wall 87, the feed flows over the edge and further in the openings 84*b* arranged in a second part 83*b* of the splitter opening arrangement 83. Again in this embodiment, every second opening 84*b* have conduits in communication with the first distributor outlet 82-1, and the remaining openings 84*b* have conduits in communication with the second distributor outlet 82-2. In this embodiment the splitter opening arrangement parts 83*a* and 83*b* is detachably arranged in relation to the rest of the conduit arrangement. Thus, when worn out, these parts are easily replaced with new corresponding parts. Deflection plates 92 are arranged downstream of the splitter opening arrangement 83. For the openings in communication with the first distributor outlet 82-1, the deflection plates 92-1 cover the full opening extension in the feed flow direction F in order to lead the feed to the first distributor outlet 82-1. For the openings in communication with the second distributor outlet 82-2, the deflection plates 92-2 partially cover the opening extension in the feed flow direction F. The conduit between the splitter opening arrangement 83 and second distributor outlet 82-2 may comprise an overflow restrictor plate 93. This ensures that the feed is spread to the full width W of the distributor 8 before entering out through the distributor outlet 82-2 and onto the screen deck 30 to which it is aligned in feeding position.

In the shown embodiments the splitter opening arrangement 83 comprises openings 84 of equal widths. However, in one embodiment the splitter opening arrangement comprises openings 84 of different sizes, e.g. different width of the openings. With such an arrangement, the feed may be differentiated to the two distributor outlets.

In another embodiment the distribution of the openings 84 having conduits in communication with a first distributor outlet 82-1 and the openings having conduits in communication with the second distributor outlet 82-2 is tailored. In this way the feed speed and the feed positioning may be tailored for each screen deck 3.

The distributor outlets 8*a* may in one embodiment comprise a flexible material to bridge any distance between the distributor outlet 82-1 and 82-2 and the screen decks 3.

The screening apparatus 1 may further comprise a second abutment support 11, also this attached to the lower part 2*a* of the support 2, and this second abutment support 11 is arranged to provide an abutment surface for the feed unit 7 when set in the maintenance position as shown in FIG. 3.

Figure 6:
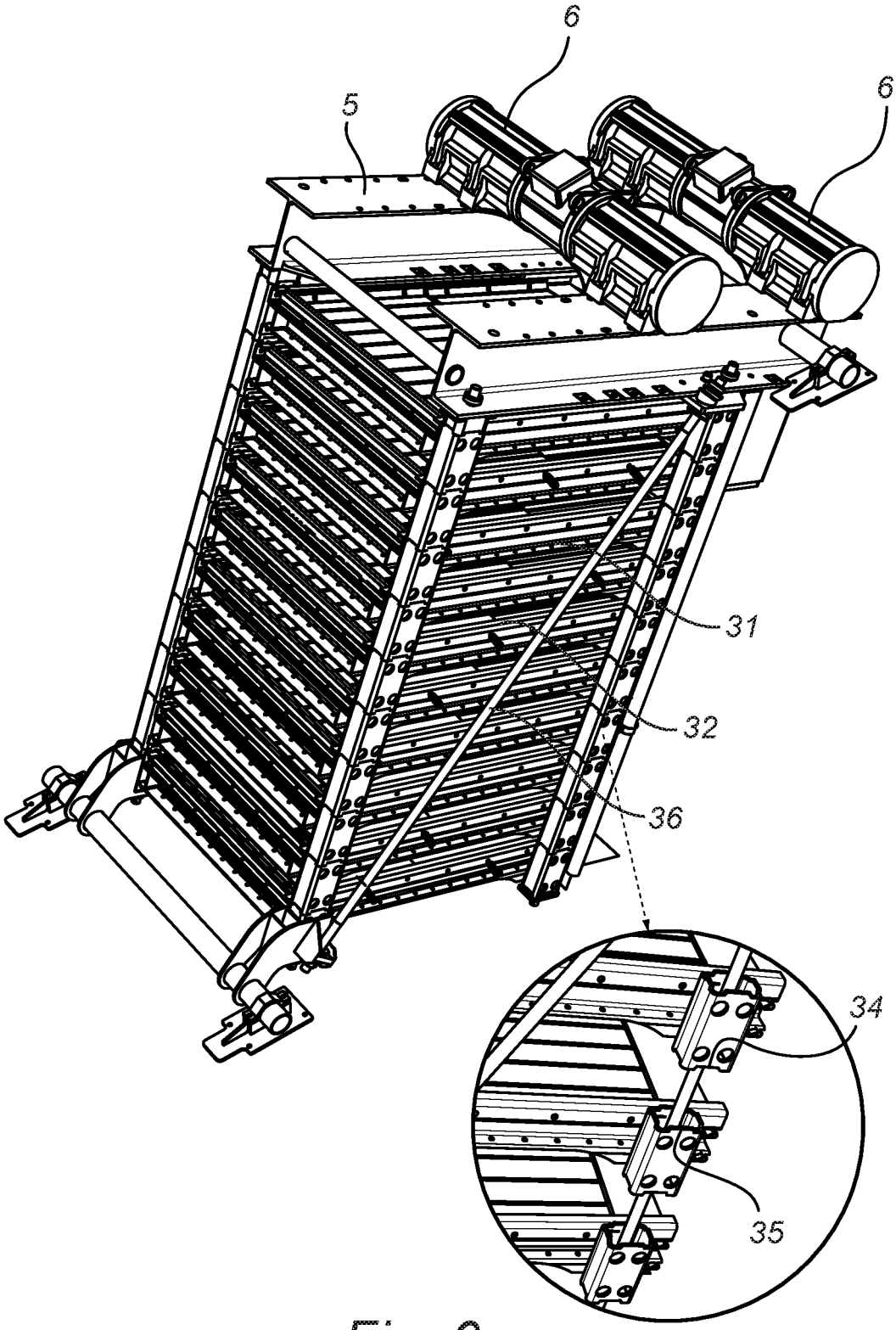
FIG. 6 is a perspective view of the screen deck assembly with a drive support including a motor assembly according to one embodiment of the invention, further showing a close up and exploded view of a part of the screen frames.

In FIG. 6 a perspective view of the assembly of the screen decks 30 together with the drive support 5 and the motor assembly 6 is shown. Each screen deck 30 comprises a screen frame 31, a screen 32 and a chamber underlaying the screen surface. The chamber is not evident from FIG. 6. As shown in FIGS. 1, 2 and 3, the screening apparatus 1 has an outlet duct 12 for oversized material and an outlet duct 13 for undersized material. The outlet duct 12 for oversized material is in communication with the upper surface of the screen decks 30, and the outlet duct 13 for undersized material is in communication with the chambers.

The screen decks 30 may be piled directly on top of each other by piling the screen frames 31 on top of each other. In the shown embodiment, and also evident from the close up shown in FIG. 6, the aligning of the screen frame 31 is made with the aid of notches 34 and protrusions 35 arranged on the screen frames 31, which notches 34 and protrusions 35 are configured to interact with corresponding notches 34 and protrusion 35 on the adjacent screen decks 30 in the assembly.

The screen decks 30 are held together by a tension strut 36, but the screen deck assembly 3 as such is self-supporting with the piled screen frames 31.

Figure 7:
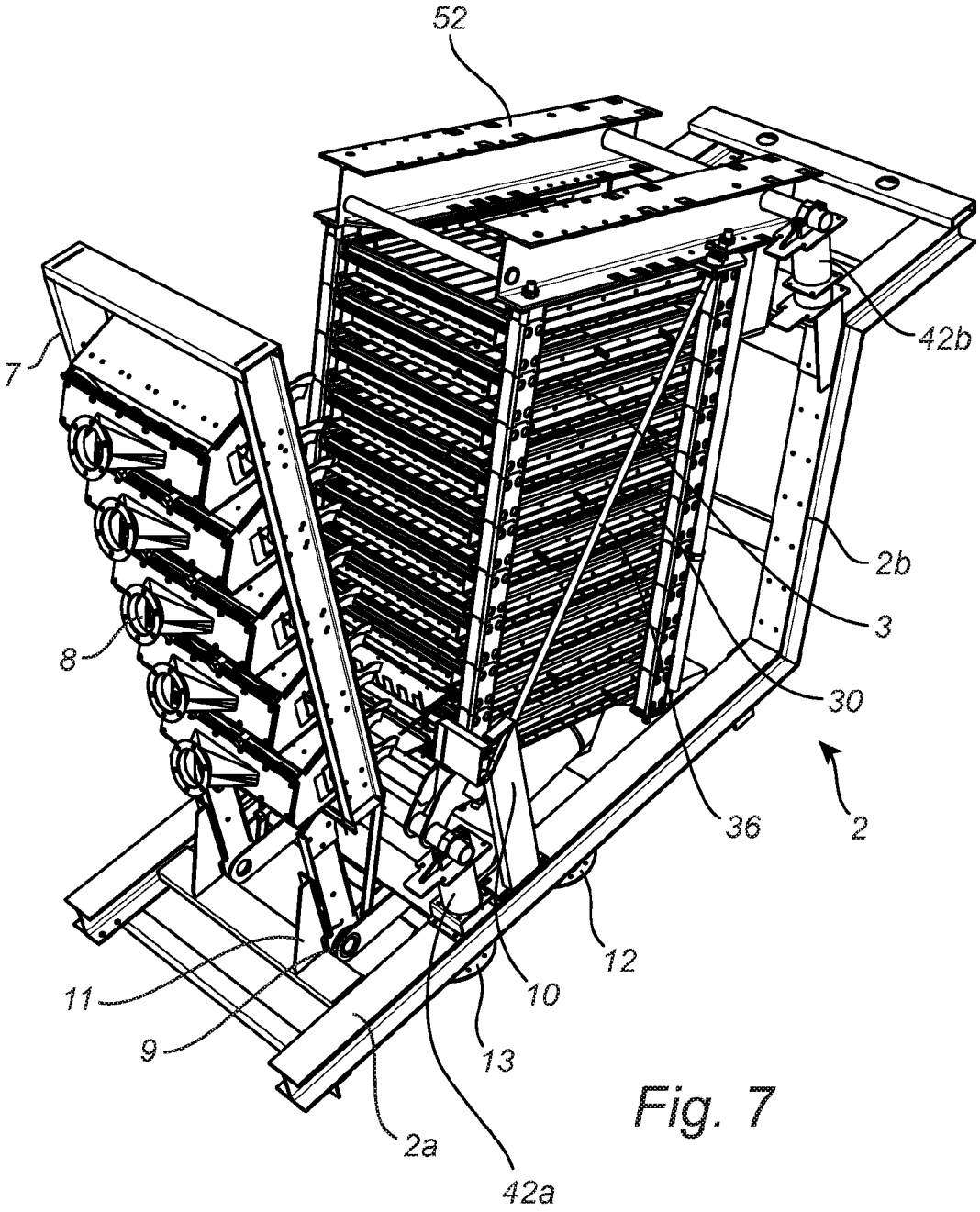
FIG. 7 is a perspective view of a screening apparatus according to another embodiment of the invention.

When maintenance is to be made on the assembly of screen decks 30 or on the feed unit, the feed unit 7 is moved to its maintenance position, as shown in FIG. 3 and FIG. 7. In this position, the feed unit 7 may be maintained and/or the assembly 3 of screen decks 30 may be maintained.

In FIG. 7 another embodiment of the invention is shown, a screening apparatus 1 that not is arranged to vibrate during operation. As seen in FIG. 7, the mountings 42*a* and 42*b* are non-resilient mountings, and an ordinary upper support 52 is attached to the second side 2*b* of the assembly 3 of screen decks 30, which support 52 is attached to the inclined part 2*b* of the support 2.

The skilled person realizes that a number of modifications of the embodiments described herein are possible without departing from the scope of the invention, which is defined in the appended claims.

For instance, the relative positioning of the various components, including the redirecting walls and splitter opening arrangement may be altered without departing from the scope of the invention.

Further, the support 2 may comprise separate support members arranged for mounting of the first side 3*a* of the assembly 3 and the abutment support 10, and for the mounting of the articulated coupling 9. A further separate support member may be arranged for mounting of the second side 3*b* of the assembly 3, either directly, or in case of a vibratory screening apparatus 1, via a drive support 5.

The invention claimed is:

1. A screening apparatus comprising:

a support;

at least two screen decks arranged one over the other as an assembly, each screen deck including a screen frame, a screen and a chamber underlaying the screen surface, an outlet duct for oversized material and an outlet duct for undersized material that is in communication with the chamber;

mountings configured for mounting of the assembly of the at least two screen decks to the support; and a feed unit configured to feed the material to be screened to each screen deck; wherein the feed unit comprises at least one distributor having one distributor inlet and at least two distributor outlets, which at least two distributor outlets are arranged to feed one screen deck each, wherein the feed unit further comprises a splitter opening arrangement with openings having conduits that are divided to either be in communication with a first distributor outlet of the at least two distributor outlets or to be in communication with a second distributor outlet of the at least two distributors; and wherein the feed unit is configured to compel the feed to spread to the full width of the feed unit before entering the splitter opening arrangement.

2. The screening apparatus according to claim 1, wherein the at least one distributor has a conduit arrangement comprising the splitter opening arrangement, which comprises openings arranged in an extension perpendicular to a feed flow direction (F), and which openings have conduits that are divided to either be in communication with the first distributor outlet of the at least two distributor outlets or to be in communication with the second distributor outlet of the at least two distributor outlets.

3. The screening apparatus according to claim 2, wherein the splitter opening arrangement comprises vanes arranged in parallel with each other forming vane openings in between the vanes.

4. The screening apparatus according to claim 2, wherein the conduit arrangement, upstream of the splitter opening arrangement, further comprises:

a first redirecting wall;

a bottom wall; and a second redirecting wall.

5. The screening apparatus according to claim 4, wherein vanes are arranged perpendicular to the second redirecting wall, wherein the vanes form openings, which are configured to split the feed of material before reaching an end of the second redirecting wall.

6. The screening apparatus according to claim 2, wherein the splitter opening arrangement is detachably arranged in relation to the rest of the conduit arrangement.

7. The screening apparatus according to claim 6, wherein the splitter opening arrangement comprises at least two detachably arranged parts in relation to the rest of the conduit arrangement.

8. The screening apparatus according to claim 2, wherein the splitter opening arrangement comprises openings of different sizes for differentiated feed to each of the at least two distributor outlets.

9. The screening apparatus according to claim 2, wherein the splitter opening arrangement comprises a tailored distribution between openings having conduits in communication with a first distributor outlet of the at least two distributor outlets and openings having conduits in communication with a second distributor outlet of the at least two distributor outlets.

10. The screening apparatus according to claim 2, wherein the splitter opening arrangement comprises deflection plates arranged downstream of the splitter opening arrangement.

11. The screening apparatus according to claim 2, wherein at least one of the conduits between the splitter opening arrangement and the at least two distributor outlets comprises an overflow restrictor plate.

12. A screening apparatus comprising screen decks, and a feed unit configured to feed the material to be screened to different screen decks; wherein the feed unit comprises at least one distributor having one distributor inlet and at least two distributor outlets, which at least two distributor outlets are arranged to feed one screen deck each; and wherein the at least one distributor has a conduit arrangement comprising a splitter opening arrangement, which comprises openings arranged in an extension perpendicular to a feed flow direction (F), and which openings have conduits that are divided to either be in communication with a first distributor outlet or to be in communication with a second distributor outlet of the at least two distributor outlets, wherein the feed unit is configured to compel the feed of material to spread to the full width of the feed unit before entering the splitter opening arrangement.

13. A screening apparatus comprising:

a support;

at least two screen decks arranged one over the other as an assembly, each screen deck including a screen frame, a screen and a chamber underlaying the screen surface, an outlet duct for oversized material and an outlet duct for undersized material that is in communication with the chamber;

mountings configured for mounting of the assembly of the at least two screen decks to the support;

a feed unit configured to feed the material to be screened to each screen deck, wherein the feed unit includes at least one distributor having one distributor inlet and at least two distributor outlets, which at least two distributor outlets are arranged to feed one screen deck each, wherein the feed unit further comprises a splitter opening arrangement with openings having conduits that are divided to either be in communication with a first distributor outlet of the at least two distributor outlets or to be in communication with a second distributor outlet of the at least two distributors; and at least one redirecting wall positioned perpendicular to a feed flow direction to compel the feed flow to spread the full width of the feed unit before entering the splitter opening arrangement.

* * * * *